$$q = \frac{\kappa}{d}(T_L - T_W) \quad (3)$$

where $\kappa$=thermal conductivity of insulating band 80 d=thickness of insulating band 80

$T_W$=temperature of mold coolant

Substituting the expression for q from Equation (3) into Equation (2), we can solve for the minimum thickness d as $$d \geqq \frac{2\,\delta\,\kappa\,(T_L - T_W)}{S\,R\,\rho\,Cp\,(T_I - T_L)} \quad (4)$$

From Equation (4) it can be seen that as the conductivity of the insulating material of band 80 increases, so does the minimum thickness d. The relation between the thickness and the casting speed and width of band is explained by the effect of these parameters on contact time against mold wall 21, wall 64, or sleeve 64'.

It is of interest to note that in typical continuous casting systems quite thin insulating bands have been found to be effective. This can be readily appreciated from a consideration of the following casting system. Assuming a band width $\delta$=1 cm, $\kappa=10^{-4}$ cal/cm sec °K., $T_L$=700° C., $T_W$=100° C., S=25.4 cm/min, R=3.18 cm, $\rho$=2.37 g/cm$^3$, Cp=0.2 cal/g °K. and $T_I$=750° C., d is calculated in accordance with Equation (4) to be d≧0.038 mm=0.015 in. Thus, in accordance with this invention, insulating layers 80 which have been sprayed onto the outside (coolant) surface of wall 21, wall 64, or sleeve 64' have been found to be quite effective in preventing sudden changes in heat flux through the sprayed liner or wall along the sprayed (affected) zone. As shown in FIG. 8, the top of insulating band 80 may extend higher than hot-top projection 72 as a safety factor in preventing high heat transfer at that particular area. Likewise, the top of insulating band 80 may extend higher than the lower edge projection 43 of liner 42.

While it is contemplated that the bulk properties of the mold wall itself could be changed by means other than spraying or coating, as by altering mold wall material in the zone of interest or the affected area, such mold modifications would be unnecessarily complex and expensive. A variation of such an approach might be to machine out or form a slot on the outside surface (coolant side) of mold wall 21, wall 64, or sleeve 64' and thereafter insert solid bands of different materials and/or thicknesses. Such inserts on the inside (molten metal side) of wall 21, wall 64, or sleeve 64' would be less desirable in that discontinuities along the mold casting surface might be encountered. It should also be appreciated that insulating bands could be adhesively secured to the outside surface of the mold wall as an alternative to spraying or painting.

Any insulating material of lower thermal conductivity or diffusivity than the mold wall and that is stable in the coolant utilized in the casting process is suitable for use in the instant invention, as for example, metals with low thermal conductivity, metal alloys, oxides, metal oxides, any suitable polymeric coating material such as that desired by the trademark GLYPTAL, resins, enamel, epoxy, plastics, or any other suitable insulating material.

The photograph of FIG. 9 shows a six inch diameter alloy AA 6061 casting which was continuously cast utilizing the casting apparatus depicted in FIG. 1. Casting was carried out at a temperature of 1280°–1300° F., a speed of 7 in/min, a field strength of 600 gauss, and a coolant flow rate of 26 gpm. The photograph of FIG. 10 depicts another six inch AA 6061 casting made utilizing the same casting apparatus and system parameters with the exception of the addition of a narrow (¾ inch wide) spray-on band of insulating material on the cooling water side of the casting mold liner. Use of the insulating band has the concomitant effect of reducing the thickness of the columnar zone on the periphery of the casting and reducing the severity of cold folding and inverse segregation.

The techniques described hereinabove in accordance with the present invention serve to vary the heat extraction rate associated with continuous casting systems smoothly from essentially zero to the normal value associated with a water cooled casting mold. This smooth transition permits growth and development of the ingot shell under controlled, less severe conditions. As a result, various benefits accrue. Firstly, meniscus related effects, such as cold folds associated with alternating freezing and meniscus formation are essentially eliminated. Consequently, the susceptibility to hot tearing is greatly reduced. Secondly, the slower solidification rate reduces the tendency for the alloy to segregate during the initial stages of casting. Accordingly, inverse segregation associated with the rapid cooling/reheating cycle will be reduced, with concomitant improvement in surface quality. The reduced initial solidification rate will also result in a smaller columnar zone on the periphery of the ingot, which leads to improved performance in subsequent processing.

It is envisaged that this invention can be used for casting all metals and alloys. Selection of the mold material, lubricant, coolant, etc. will be dependent upon the particular alloy or metal being cast and may be those typically utilized in the casting arts.

The United States patents and patent applications described hereinabove and the disclosures therein are intended to be incorporated by reference.

It is apparent that there has been provided with this invention a novel process and apparatus for varying the heat extracton rate associated with continuous casting systems smoothly from essentially zero to the normal value associated with a cooled casting mold which fully satisfy the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In an apparatus for continuously or semi-continuously forming a semi-solid thixotropic alloy slurry, said slurry comprising throughout its cross section degenerate dendrite primary solid particles in a surrounding matrix of molten metal, said apparatus comprising:

means for containing molten metal including a mold wall for containing and extracting heat from said thixotropic slurry, said containing means having a desired cross section;

means for controllably cooling said molten metal in said containing means; and

United States Patent [19]

Taguchi et al.

[11] 4,450,894

[45] May 29, 1984

[54] METHOD FOR HORIZONTAL TYPE CONTINUOUS CASTING

[75] Inventors: Kiyomi Taguchi; Masayuki Hanmyo; Masaru Ishikawa, all of Fukuyama, Japan

[73] Assignee: Nippon Kokan Kabushiki Kaisha, Tokyo, Japan

[21] Appl. No.: 503,074

[22] Filed: Jun. 13, 1983

Related U.S. Application Data

[63] Continuation of Ser. No. 328,409, Dec. 7, 1981, abandoned, which is a continuation-in-part of Ser. No. 160,079, Jun. 16, 1980, abandoned.

[30] Foreign Application Priority Data

Jul. 10, 1979 [JP] Japan ..... 54-86495

[51] Int. Cl.[3] ..... B22D 11/00

[52] U.S. Cl. ..... 164/484; 164/490

[58] Field of Search ..... 164/478, 490, 484

[56] References Cited

U.S. PATENT DOCUMENTS 3,669,176 6/1972 Krall et al. ..... 164/478 X
3,721,288 3/1973 Vogt et al. ..... 164/478
4,211,270 7/1980 Shinopulos et al. ..... 164/478

FOREIGN PATENT DOCUMENTS 53-44429 4/1978 Japan ..... 164/440
1087026 10/1967 United Kingdom ..... 164/478

*Primary Examiner*—Kuang Y. Lin
*Attorney, Agent, or Firm*—Frishauf, Holtz, Goodman & Woodward

[57] ABSTRACT

A method for horizontal type continuous casting, which comprises: withdrawing a cast strand from a mold provided horizontally at the lower part of a tundish at a prescribed withdrawing speed for a prescribed period of withdrawing time; then, pushing back said cast strand for a prescribed period of pushback time in the direction opposite to the direction of withdrawal; and, withdrawing said cast strand again from said mold at said prescribed withdrawing speed for said prescribed period of withdrawing time; repeating said withdrawal and said pushing back, the distance of said withdrawal being longer than that of said pushing back; thereby intermittently withdrawing said cast strand from said mold; said method being characterized by comprising: limiting said prescribed withdrawing speed within the range of from 1.0 to 10.0 m/minute; limiting said prescribed period of withdrawing time within the range of from 0.05 to 1.5 second; and, limiting said prescribed period of pushback time within the range of from 0.1 to 0.6 second; thereby preventing a breakout and a crack from occurring in the trailing end portion of the solidified shell of the cast strand in said mold.

1 Claim, 3 Drawing Figures

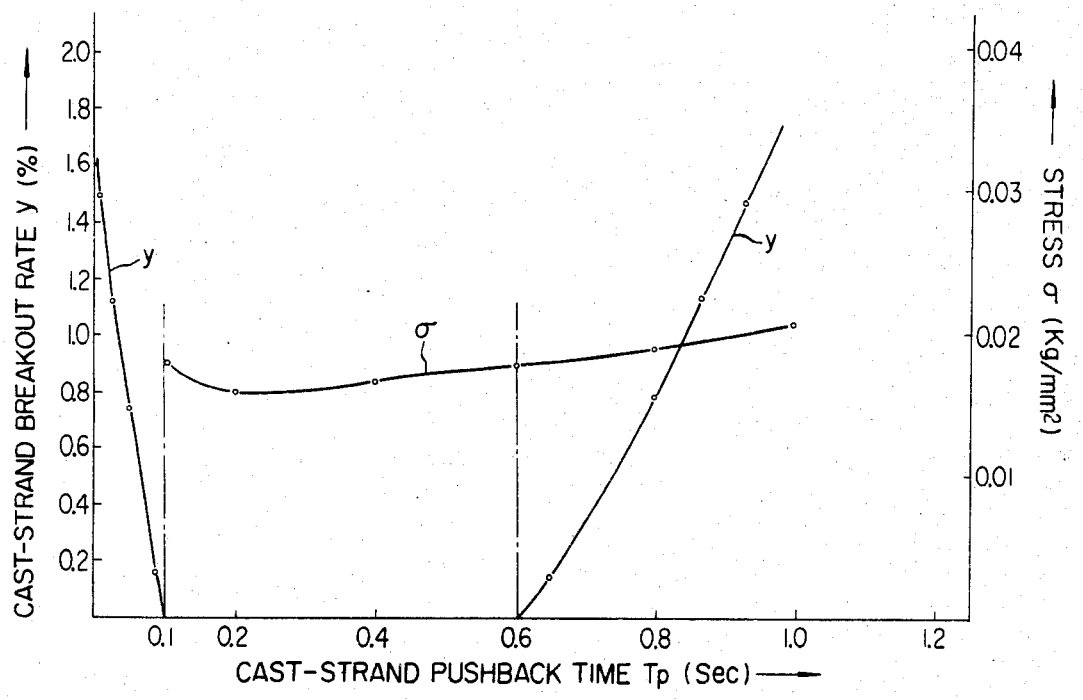

METHOD FOR HORIZONTAL TYPE CONTINUOUS CASTING

RELATED APPLICATION

This application is a continuation of application Ser. No. 328,409, filed Dec. 7, 1981, now abandoned, which, in turn, is a continuation-in-part of Ser. No. 160,079, filed June 16, 1980, now abandoned.

FIELD OF THE INVENTION

The present invention relates to a method for a horizontal type continuous casting, which eliminates the risk of a breakout and a crack occurring in the trailing end portion of the solidified shell of a cast strand in a mold when intermittently withdrawing the cast strand from the mold, and permits casting of a cast strand of satisfactory quality.

BACKGROUND OF THE INVENTION

In place of the vertical type continuous casting process which comprises casting steel by vertically withdrawing a cast strand from a vertical mold installed below a tundish, the horizontal type continuous casting process which comprises casting steel by horizontally withdrawing a cast strand from a horizontal mold installed at the lower part of the side wall of a tundish is recently being industrialized because of the low installation costs and other advantages.

One of the problems involved in the continuous casting process is that molten steel may adhere or stick to the inner wall of the mold when withdrawing a cast strand from the mold, and thereby the cast strand may not sometimes be withdrawn properly from the mold.

In the vertical type continuous casting process, in which a mold is installed below a tundish not directly connected to the tundish, it is possible to prevent molten steel from adhering or sticking to the mold by vibrating the mold itself while withdrawing the cast strand from the mold.

In the horizontal type continuous casting process, in contrast, a mold is horizontally installed onto the side wall of a tundish, in direct connection with the tundish. Unlike the vertical type continuous casting process, it is difficult, from the point of view of equipment, to vibrate only the mold while withdrawing the cast strand from the mold, and this practice is not practicable. Alternatively, it is conceivable to vibrate the tundish and the mold as an integral body. This practice is also problematic from the consideration of equipment and is not therefore practicable.

When withdrawing a cast strand from a mold in the horizontal type continuous casting process, therefore, a practicable method comprises either continuously withdrawing the cast strand from the mold at a prescribed withdrawing speed, or withdrawing the cast strand from the mold at a prescribed withdrawing speed for a prescribed period of withdrawing time, then, discontinuing withdrawal of the cast strand for a prescribed period of time, then, withdrawing the cast strand from the mold at said prescribed withdrawing speed for said prescribed period of withdrawing time, and repeating this cycle of withdrawal and discontinuance, i.e., intermittently withdrawing the cast strand from the mold.

However, the method comprising continuously withdrawing the cast strand from the mold at a prescribed withdrawing speed has the following problem. When withdrawing the cast strand from the mold, the cast strand is always pulled by pinch rolls, and movement of the cast strand in the mold is restricted by frictional resistance between the cast strand and the mold. As a result, a breakout or a crack may be caused in brittle parts of the solidified shell which is made of molten steel by a single withdrawing action of the cast strand at a molten steel supply end portion in the mold (hereinafter referred to as the "trailing end portion of solidified shell"), thus resulting in a considerably deteriorated shape of the cast strand.

On the other hand, the method comprising intermittently withdrawing the cast strand from the mold is problematic in the following point. After the cast strand is withdrawn from the mold at a prescribed withdrawing speed for a prescribed period of withdrawing time, the cast strand shrinks by cooling. However, because the cast strand is constrained by pinch rolls, and movement of the cast strand is restricted by frictional resistance between the cast strand and the mold as mentioned above, tension acts on the cast strand. As a result, breakouts and cracks are caused in the brittle parts in the trailing end portion of the solidified shell of the cast strand in the mold, thus resulting in a considerably deteriorated shape of the cast strand.

A method capable of solving the above-mentioned problem comprises, after withdrawing the cast strand from the mold at a prescribed withdrawing speed for a prescribed period of withdrawing time, pushing back the cast strand for prescribed period of pushback time in the direction opposite to the direction of the withdrawal, and then withdrawing again the cast strand from the mold at said prescribed withdrawing speed for said prescribed period of withdrawing time, and thus intermittently withdrawing the cast strand from the mold by repeating the cycle of said withdrawal and pushing back. According to this method, since a pushback force is imparted to the cast strand in the same direction as the shrinking direction of the cast strand even when the cast strand shrinks by cooling after withdrawing the cast strand from the mold at a prescribed withdrawing speed for a prescribed period of withdrawing time, no tension acts on the cast strand. As a result, breakouts and cracks do not occur to brittle parts in the trailing end portions of the solidified shell of the cast strand in the mold.

The period of pushback time of the above-mentioned pushing back of the cast strand is limited within a certain range, and a cast strand with a satisfactory quality cannot be obtained with a period of pushback time of under or over this range.

However, since a particular optimum period of pushback time of a cast strand has not as yet been known, a cast strand with a satisfactory quality has not always been obtained even by the application of the method comprising, after withdrawing the cast strand from the mold at a prescribed withdrawing speed for a prescribed period of withdrawing time, then, pushing back the cast strand for a prescribed period of pushback time in the direction opposite to the direction of the withdrawal, and then withdrawing again the cast strand from the mold at said prescribed withdrawing speed for said prescribed period of withdrawing time, and thus intermittently withdrawing the cast strand from the mold by repeating the cycle of withdrawal and pushback.

SUMMARY OF THE INVENTION

A principal object of the present invention is therefore to provide a method for intermittently withdrawing a cast strand from a mold without causing a breakout and a crack in brittle parts in the trailing end portion of the solidified shell of the cast strand.

In accordance with one of the features of the present invention, there is provided a method for horizontal type continuous casting, which comprises: withdrawing a cast strand from a mold provided horizontally at the lower part of a tundish at a prescribed withdrawing speed for a prescribed period of withdrawing time; then, pushing back said cast strand for a prescribed period of pushback time in the direction opposite to the direction of withdrawal; and, withdrawing said cast strand again from said mold at said prescribed withdrawing speed for said prescribed period of withdrawing time; repeating said withdrawal and said pushing back, the distance of said withdrawal being longer than that of said pushing back; thereby intermittently withdrawing said cast strand from said mold; said method being characterized by comprising: limiting said prescribed withdrawing speed within the range of from 1.0 to 10.0 m/minute; limiting said prescribed period of withdrawing time within the range of from 0.05 to 1.5 second; and, limiting said prescribed period of pushback time within the range of from 0.1 to 0.6 second, thereby preventing a breakout and a crack from occurring in the trailing end portion of the solidified shell of the cast strand in said mold.

DETAILED DESCRIPTION OF PREFERRED EMBODIMENTS

Figure 1:
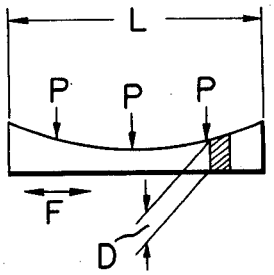
FIG. 1 is a longitudinally partially lower section of the trailing end portion of the solidified shell of a cast strand in a mold.

In the method comprising, after withdrawing a cast strand from a mold at a prescribed withdrawing speed for a prescribed period of withdrawing time, pushing back the cast strand for a prescribed period of pushback time in the direction opposite to the direction of said withdrawal, and then, withdrawing the cast strand again from the mold at said prescribed withdrawing speed for said prescribed period of withdrawing time, thus intermittently withdrawing the cast strand from the mold by repeating said withdrawal and said pushing back, the pushback time of said cast strand in the direction opposite to the direction of withdrawal exerts an important effect on the quality of the cast strand, as mentioned above.

We carried out extensive studies to determine the optimum period of pushback time of the cast strand in the direction opposite to the direction of withdrawal in the method for intermittently withdrawing the cast strand from the mole mentioned above, and obtained the following finding.

The probability of a breakout or a crack occurred to the trailing end portion of the solidified shell of the cast strand in the mold when intermittently withdrawing the cast strand from the mold depends upon the stress occurring in the section of the thinnest part in the trailing end portion of the solidified shell.

The present invention was made on the basis of the above-mentioned finding, and, in the method comprising, after withdrawing a cast strand from a mold at a prescribed withdrawing speed for a prescribed period of withdrawing time, pushing back the cast strand for a prescribed period of pushback time in the direction opposite to the direction of said withdrawal, and then, withdrawing the cast strand again from the mold at said prescribed withdrawing speed for said prescribed period of withdrawing time, thus intermittently withdrawing the cast strand from the mold by repeating said withdrawal and said pushing back, the present invention is characterized by comprising: limiting said prescribed withdrawing speed within the range of from 1.0 to 10.0 m/minute, limiting said prescribed period of withdrawing time within the range of from 0.05 to 1.5 second, and, limiting said prescribed period of pushback time within the range of from 0.1 to 0.6 second, thereby preventing a breakout and a crack from occurring in the trailing end portion of the solidified shell of the cast strand in said mold.

The following paragraphs describe the reasons why the withdrawing speed of a cast strand from a mold, the withdrawing time of the cast strand from the mold and the pushback time of the cast strand toward the mold are limited as mentioned above.

A withdrawing speed of a cast strand from a mold of under 1.0 m/minute results in a lower average withdrawing speed, thus impairing the productivity. At a withdrawing speed of the cast strand from the mold of over 10 m/minute, on the other hand, a sharp tension is applied to the solidified shell of the mold, thus bringing about the risk of causing a breakout. The withdrawing speed of the cast strand from the mold should therefore be limited within the range of from 1.0 to 10.0 m/minute.

A withdrawing time of the cast strand from the mold of under 0.05 second does not allow normal operations since the withdrawing time comes to an end before the prescribed withdrawing speed is reached. With a withdrawing time of the cast strand from the mold of over 1.5 second, on the other hand, the surface condition of the cast strand is deteriorated. The withdrawing time of the cast strand from the mold should therefore be limited within the range of from 0.05 to 1.5 second.

Figure 2:
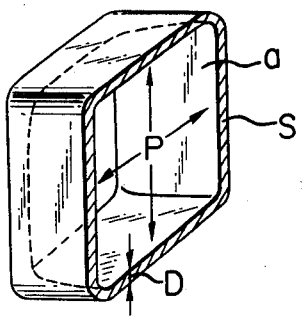
FIG. 2 is a perspective view illustrating the thinnest part in the trailing end portion of the solidified shell of a cast strand in a mold; and, FIG. 3 is a drawing illustrating the relationships of the cast strand pushback time "Tp" with the stress "$\sigma$" occurring in the section of the thinnest part in the trailing end portion of the solidified shell and with the cast strand breakout rate "y".
Figure 3:
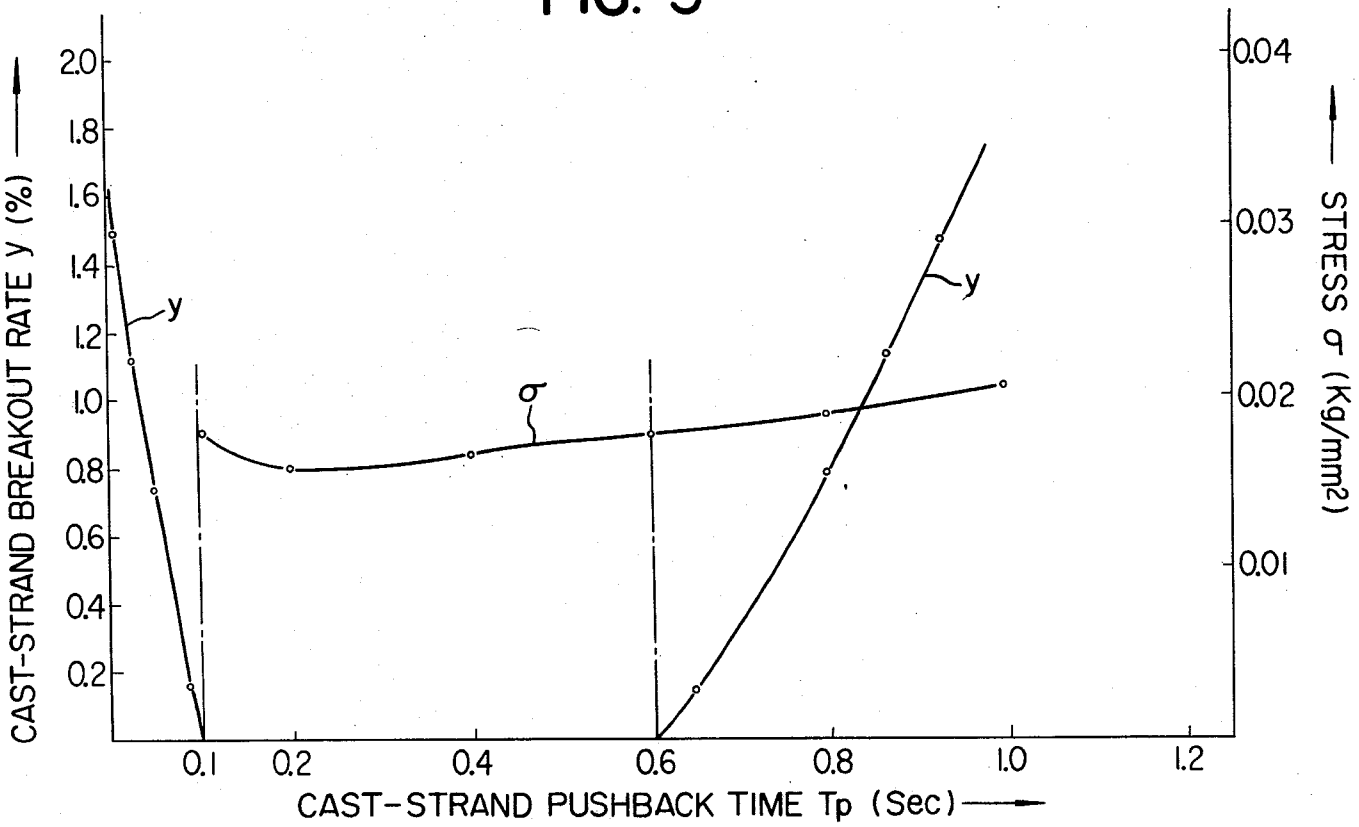

In the method of the present invention, the reasons why the period of pushback time of the cast strand toward the mold is limited within the range of from 0.1 to 0.06 second are described with reference to FIGS. 1 to 3.

When intermittently withdrawing a cast strand from a mold, the average withdrawing speed "Vc" (m/minute) of the cast strand is calculated by the following formula:

$$Vc = \frac{Tw \cdot Vw}{Tw + Tp} \quad (1)$$

where,

Tw: withdrawing time time (sec.) of the cast strand in the case where the cast strand is withdrawn from the

UNITED STATES PATENT AND TRADEMARK OFFICE

CERTIFICATE OF CORRECTION

PATENT NO. : 4,450,894

DATED : May 29, 1984

INVENTOR(S) : Kiyomi TAGUCHI et al

It is certified that error appears in the above-identified patent and that said Letters Patent is hereby corrected as shown below:

Column 7, line 25: "Vw" should be --Tw--.

Column 8, line 2 : "Vw" should be --Tw--.

Column 8, line 46 (Claim 1): "0.5" should be --0.05--.

Signed and Sealed this

*Fifth* Day of *February 1985*

[SEAL]

*Attest:*

DONALD J. QUIGG

*Attesting Officer* *Acting Commissioner of Patents and Trademarks*